US006450902B1

(12) United States Patent
Hwang

(10) Patent No.: US 6,450,902 B1
(45) Date of Patent: Sep. 17, 2002

(54) DIMPLE ARRANGEMENT OF A GOLF BALL

(76) Inventor: In Hong Hwang, 312-907, Jugon Apt., Dunchon-Dong, Kangdong-Ku, Seoul (KR)

( * ) Notice: Subject to any disclaimer, the term of this patent is extended or adjusted under 35 U.S.C. 154(b) by 103 days.

(21) Appl. No.: 09/604,996

(22) Filed: Jun. 28, 2000

(30) Foreign Application Priority Data

Apr. 20, 2000 (KR) ..... 2000-20852

(51) Int. Cl.[7] ..... A63B 37/12

(52) U.S. Cl. ..... 473/383

(58) Field of Search ..... 473/378–384

(56) References Cited

U.S. PATENT DOCUMENTS

| | | | | | |
|---|---|---|---|---|---|
| 5,149,100 | A | * | 9/1992 | Melvin et al. | 473/384 |
| 5,441,276 | A | * | 8/1995 | Lim | 473/379 |
| 5,482,286 | A | * | 1/1996 | Molitor et al. | 473/372 |
| 6,179,731 | B1 | * | 1/2001 | Shimosaka et al. | 473/384 |
| 6,200,232 | B1 | * | 3/2001 | Kasashima et al. | 473/384 |

* cited by examiner

*Primary Examiner*—Steven Wong
*Assistant Examiner*—Raeann Gorden
(74) *Attorney, Agent, or Firm*—Amster, Rothstein & Ebenstein

(57) ABSTRACT

A golf ball has a plurality of dimples in its spherical outer surface, in a pattern such that the drag coefficient of the golf ball is reduced and the air resistance of the ball is minimized in a low-speed area during its flying so that the carry distance is increased.

8 Claims, 3 Drawing Sheets

Unit : Degree ( L ; Longitude, La ; Latitude )

P1 = ( L : 0, La : 0 )
P2 = ( L : 30, La : 54.7356098 )
P3 = ( L : 19.1066054, La : 0 )
P4 = ( L : 40.89339465, La : 0 )
P5 = ( L : 60, La : 35.26438969 )
P6 = ( L : 60, La : 0 )
P7 = ( L : 79.1066054, La : 0 )
P8 = ( L : 90, La : 54.7356098 )
P9 = ( L : 100.89339465, La : 0 )
P10 = ( L : 120, La : 0 )
P11 = ( L : 139.1066054, La : 0 )
P12 = ( L : 160.89339465, La : 0 )
P13 = ( L : 150, La : 54.7356098 )
P14 = ( L : 180, La : 0 )
P15 = ( L : 180, La : 35.26438969 )
P16 = ( L : 199.1066054, La : 0 )
P17 = ( L : 210, La : 54.7356098 )
P18 = ( L : 270, La : 54.7356098 )
P19 = ( L : 220.89339465, La : 0 )
P20 = ( L : 240, La : 0 )
P21 = ( L : 259.1066054, La : 0 )
P22 = ( L : 280.89339465, La : 0 )
P23 = ( L : 300, La : 0 )
P24 = ( L : 319.1066054, La : 0 )
P25 = ( L : 330, La : 54.7356098 )
P26 = ( L : 340.89339465, La : 0 )
P27 = ( L : 0, La : 35.26438969 )

The diameter of dimples

| | |
|---|---|
| A = 0.185″~ 0.195″ | B = 0.180″~ 0.190″ |
| C = 0.155″~ 0.165″ | D = 0.150″~ 0.160″ |
| E = 0.140″ ~0.145″ | F = 0.130″ ~ 0.135″ |
| G = 0.115″~ 0.125″ | H = 0.110″~ 0.120″ |

$A \geqq B > C \geqq D > E > F > G \geqq H$

Unit : Degree ( L ; Longitude, La ; Latitude )

P1 = ( L : 0, La : 0 )
P2 = ( L : 30, La : 54.7356098 )
P3 = ( L : 19.1066054, La : 0 )
P4 = ( L : 40.89339465, La : 0 )
P5 = ( L : 60, La : 35.26438969 )
P6 = ( L : 60, La : 0 )
P7 = ( L : 79.1066054, La : 0 )
P8 = ( L : 90, La : 54.7356098 )
P9 = ( L : 100.89339465, La : 0 )
P10 = ( L : 120, La : 0 )
P11 = ( L : 139.1066054, La : 0 )
P12 = ( L : 160.89339465, La : 0 )
P13 = ( L : 150, La : 54.7356098 )
P14 = ( L : 180, La : 0 )
P15 = ( L : 180, La : 35.26438969 )
P16 = ( L : 199.1066054, La : 0 )
P17 = ( L : 210, La : 54.7356098 )
P18 = ( L : 270, La : 54.7356098 )
P19 = ( L : 220.89339465, La : 0 )
P20 = ( L : 240, La : 0 )
P21 = ( L : 259.1066054, La : 0 )
P22 = ( L : 280.89339465, La : 0 )
P23 = ( L : 300, La : 0 )
P24 = ( L : 319.1066054, La : 0 )
P25 = ( L : 330, La : 54.7356098 )
P26 = ( L : 340.89339465, La : 0 )
P27 = ( L : 0, La : 35.26438969 )

DIMPLE ARRANGEMENT OF A GOLF BALL

BACKGROUND OF THE INVENTION

1. Field of the Invention

The present invention relates to dimple arrangement of a golf ball which allows to extend its flying distance, and more particularly to such dimple arrangement which allows to reduce the drag coefficient of the golf ball and minimize the air resistance by making the continuous regions of air stream and, in particular by arranging the large dimple in those regions to flow out the collided air easily in a low-speed area during its flying.

2. Description of the Relevant Art

Generally, in the case of the circular shape or elliptical shape of dimples of a golf ball, the dimples are arranged by dividing the outer surface of a golf ball into the faces of a spherical polyhedron in which the kinds of the faces are composed of polygons such as triangle, square, pentagon, hexagon, heptagon, octagon and so on. And, the dimples are arranged by using one of those kinds or two kinds, or three kinds, in the divisional surface of the sphere. But, restrictions will happen by the dimples being arranged in an identical polygon which coincide with the symmetrical polygon in order to achieve a spherical symmetry of the golf ball by the rule of R&A and U.S.G.A. That is, the dimples being arranged one kind of identical size and shape or some kinds of size in a polygon of the aforementioned polyhedron, the dimples cannot help being arranged evenly in size and shape in the case of many kinds of dimples. Even if the polygon which holds a vertex in common, or holds a side in common, or apart from another, is accomplished a symmetry between identical polygons which are composed of a, spherical polyhedron, the dimples are distributed intermittently in each polygon, therefore there is no dividing method which guiding out the air-flow by the continuous connection of the groups of larger sized dimples that allows to reduce the drag coefficient of the golf ball in a low-speed area during its flying. As a golfer hits a golf ball, strong repulsive elasticity is generated on the ball by the power applied from the head of a golf club, and the back-spin is generated by the loft angle of a golf club. The impacted ball as explained above will fly at high speed, obtained the aid of aerodynamic lift, the golf ball flies at high speed until the apex of trajectory and at low-speed till the landing point from the apex of trajectory. In the case of circular dimples, the dimple coverage for obtaining the sufficient aerodynamic lift in a high-speed area should be more than 76% about all of the surface of golf ball, and it is possible for a desired carry distance to obtain aerodynamic lift when the number of dimples whose size is more than 0.145" (3.683 mm) shared more than 60% among the total number of dimples in the surface of golf ball. Even though the dimple coverage is more than 76% when the number of dimples whose size is more than 0.145" (3.683 mm) shared less than 60% among the total number of dimples, it is difficult to obtain sufficient aerodynamic lift in a high-speed area and increase the carry distance by a severe pressure drag in a low-speed area. There is no doubt that it should be helpful to obtain the aerodynamic lift by deepening the depth of the dimples whose size is less than 0.145" (hereinafter referred as small dimples), but when the depth of dimples which have a diameter from 0.115" to 0.145" is more than 6% about the diameter, the carry distance decrease by increasing the pressure drag abruptly that caused a so-called Hop due to making the whirlpool excessively in the air stream in a high-speed area. On the other hand, in the case of dimples which have the diameter more than 0.145" (hereinafter referred as large dimples), the proper depth is 0.006"~0.0075" by reason that the carry distance is able to decrease since, in a high-speed area, the pressure drag applied in the large dimples is enlarged remarkably compared to the small dimples. In the case of small dimples whose depth is 0.0057"~0.0062", although an influence upon the aerodynamic lift in a high speed area is immaterial compared to the large dimples, the small dimples act as a controller against the excessive higher trajectory by decreasing the higher pressure drag of large dimples in a high-speed area, and act as a flying stabilizer by preventing the golf ball from fluttering by the hard wind, of which the air-flow is distributed into smaller size over the surface of the golf ball in a low-speed area. But, the pressure drag is increased in a low-speed area by the small dimples basically compared to the large dimples, so it is important to arrange the large dimples and small dimples properly in a dimple arrangement. Accordingly, acting to the best of the ability of large dimples in a low-speed area is the most important factor of carry distance in the dimple arrangement.

Therefore, it is an object of the present invention to provide a new divisional composition in the surface of sphere different from a common divisional composition to increase the carry distance of the golf ball.

It is another object of the present invention to provide dimple arrangement of a golf ball which allows to reduce the drag coefficient of the golf ball and minimize the air resistance by making the continuous regions of air stream and arranging the large dimples in those regions to flow out the collided air easily in a low-speed area during its flying.

SUMMARY OF THE INVENTION

The present invention provides a new divisional composition in the surface of sphere different from a common divisional composition, in which a golf ball has a plurality of dimples in its spherical outer surface and its spherical outer surface is divided by a great circle path which passing through the points P1(longitude0 degree, latitude0 degree), P2(longitude30 degree, latitude54.7356098 degree), P13 (longitude150 degree, latitude54.7356098 degree) and P14 (longitude180 degree, latitude0 degree), while an arbitrary point of its spherical outer surface acts as a pole, and further divided by a great circle path which passing through the points P6(longitude60 degree, latitude0 degree), P2, P18 (longitude270 degree, latitude54.7356098 degree) and P20 (longitude 240 degree, latitude0 degree), further divided by a great circle path which passing through the points P10 (longitude120 degree, latitude0 degree), P13, P18 and P23 (longitude300 degree, latitude0 degree), further divided by a great circle path which passing through the points P1, P5(longitude60 degree, latitude 35.26438969 degree) and P14, further divided by a great circle path which passing through the points P7(longitude 79.1066054 degree, latitude0 degree), P25(longitude 330 degree, latitude54.7356098 degree) and P21(longitude 259.1066054 degree, latitude0 degree), further divided by a great circle path which passing through the points P9(longitude 100.89339465 degree, latitude 0 degree), P17(longitude210 degree, latitude54.7356098 degree) and P22(longitude 280.89339465 degree, latitude0 degree), further divided by a great circle path which passing through the points P10, P15(longitude180 degree, latitude 35.26438969 degree) and P23, further divided by a great circle path which passing through the points P16(longitude 199.1066054 degree, latitude 0 degree), P8(longitude 90 degree, latitude 54.7356098 degree) and P3(longitude 19.1066054 degree, latitude 0 degree), further divided by a great circle path which passing through the points P19(longitude 220.89339465 degree, latitude 0 degree), P25 and P4(longitude 40.89339465 degree, latitude 0 degree), further divided by a great circle path which passing through the points P20, P27(longitude 0 degree, latitude 35.26438969) and P6, further divided by a great circle path which passing through the points P24 (longitude 319.1066054 degree, latitude 0 degree), P17 and P11(longitude 139.1066054 degree, latitude 0 degree), further divided by a great circle path which passing through the points P26(longitude 340.89339465 degree, latitude 0 degree), P8 and P12(longitude 160.89339465 degree, latitude 0 degree), and the spherical outer surface is further divided by a great circle path which acts as a equator, passing through the points P1, P7, P14, P16, and P24.

Regarding the dimple arrangement, the dimples in the regions(F1, F2, F3, F4, F5, F6, F7, F8, F9) which are able to induce the continuous regions of air stream in the surface of golf ball, in particular, indicated by the black slanting lines in FIG. 4 are relatively larger than those of the large spherical triangle in the central region in the surface of the sphere by above 10% in size, and connected to the first large size dimples which exist one by one in the regions of S1, S2, S3 (6 regions exist included same regions in the opposite side of the sphere.) respectively in the surface of the golf ball in a form of band. Accordingly, the drag coefficient of the golf ball is reduced and the air resistance is minimized by making the continuous regions of air stream and arranging the large dimples in those regions to flow out the collided air easily in a low-speed area during its flying, and therefore the carry distance is increased.

BRIEF DESCRIPTION OF THE DRAWINGS

The present invention will be explained in conjunction with an illustrative embodiment shown in the accompanying drawings, in which.

DETAILED DESCRIPTION OF THE PREFERRED EMBODIMENT

Figure 2:
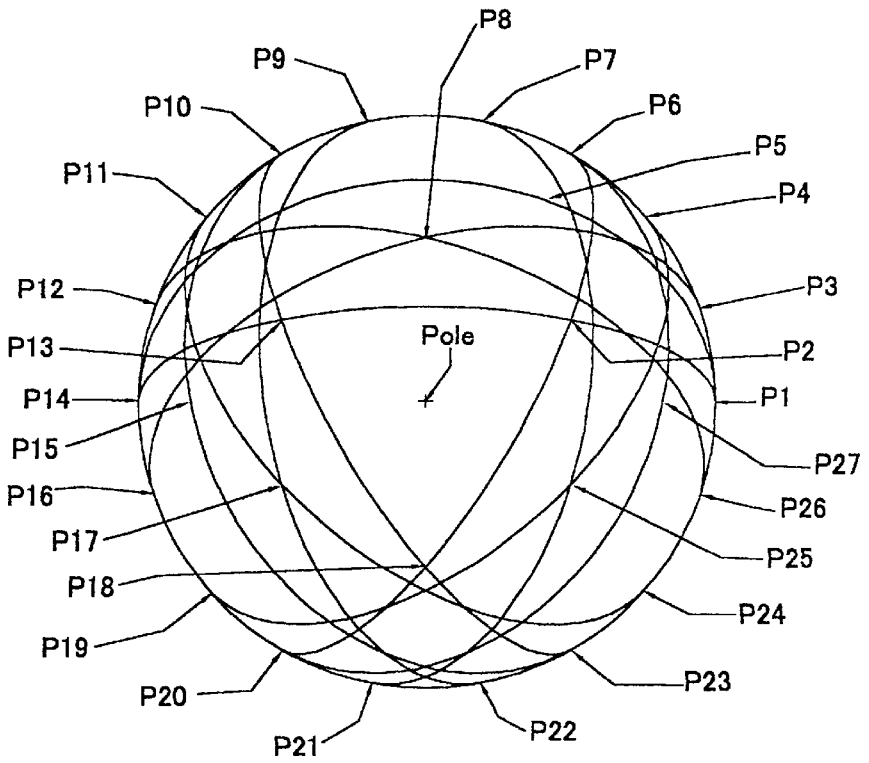
FIG. 2 illustrates the great circle paths which passing through the positions represented as longitude and latitude in the divisional composition of the surface of sphere by the great circle paths for arranging the dimples in accordance with the present invention. In the drawing, P1 is the position of longitude 0 degree and latitude 0 degree, P2 is the position of longitude 30 degree and latitude 54.7356098 degree, and each position of P3~P27 has an longitude and latitude as shown in the drawing.
Figure 3:
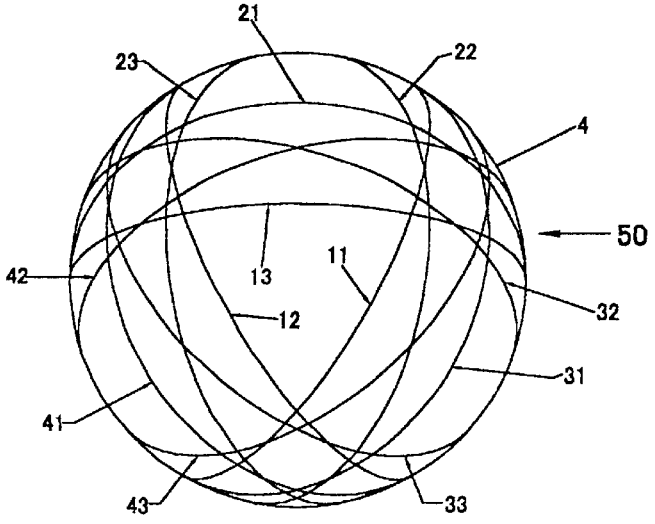
FIG. 3 shows the great circle paths which dividing the surface of sphere in FIG. 2 in accordance with the present invention.

In the present invention, the spherical outer surface(50 in FIG. 3) of the golf ball is divided by a great circle path(13 in FIG. 3) which passing through the points P1(longitude 0 degree, latitude 0 degree), P2(longitude 30 degree, latitude 54.7356098 degree), P13(longitude 150 degree, latitude 54.7356098 degree) and P14(longitude 180 degree, latitude 0 degree), while an arbitrary point of its spherical out surface acts as a pole as shown in FIG. 2, and further divided by a great circle path(11 in FIG. 3) which passing through the points P6(longitude 60 degree, latitude 0 degree), P2, P18 (longitude 270 degree, latitude 54.7356098 degree ) and P20(longitude 240 degree, latitude 0 degree), further divided by a great circle path(12 in FIG. 3) which passing through the points P10(longitude 120 degree, latitude 0 degree), P13, P18 and P23(longitude 300 degree, latitude 0 degree), further divided by a great circle path(21 in FIG. 3) which passing through the points P1, P5(longitude 60 degree, latitude 35.26438969 degree) and P14, further divided by a great circle path(22 in FIG. 3) which passing through the points P7(longitude 79.1066054 degree, latitude 0 degree), P25(longitude 330 degree, latitude 54.7356098 degree) and P21(longitude 259.1066054 degree, latitude 0 degree), further divided by a great circle path(23 in FIG. 3) which passing through the points P9(longitude 100.89339465 degree, latitude 0 degree), P17(longitude 210 degree, latitude 54.7356098 degree) and P22(longitude 280.89339465 degree, latitude 0 degree), further divided by a great circle path(41 in FIG. 3) which passing through the points P10, P15(longitude 180 degree, latitude 35.26438969 degree) and P23, further divided by a great circle path(42 in FIG. 3) which passing through the points P16(longitude 199.1066054 degree, latitude 0 degree), P8(longitude 90 degree, latitude 54.7356098 degree) and P3(longitude 19.1066054 degree, latitude 0 degree), further divided by a great circle path(43 in FIG. 3) which passing through the points P19 (longitude 220.89339465 degree, latitude 0 degree), P25 and P4(longitude 40.89339465 degree, latitude 0 degree), further divided by a great circle path(31 in FIG. 3) which passing through the points P20, P27(longitude 0 degree, latitude 35.26438969) and P6, further divided by a great circle path(33 in FIG. 3) which passing through the points P24(longitude 319.1066054 degree, latitude 0 degree), P17 and P11(longitude 139.1066054 degree, latitude 0 degree), further divided by a great circle path(32 in FIG. 3) which passing through the points P26(longitude 340.89339465 degree, latitude 0 degree), P8 and P12 (longitude 160.89339465 degree, latitude 0 degree), and the spherical outer surface is further divided by a great circle path(4 in FIG. 3) which acts as a equator, passing through the points P1, P7, P14, P16, and P24. As mentioned above, the arrangement of large dimples which minimize the drag in a low-speed area makes the regions(F1, F2, F3, F4, F5, F6, F7, F8, F9) which are able to induce the continuous regions of air stream, the regions being sectioned as follows: the region(F1 which indicated by the black slanting lines in FIG. 4 ; hereinafter referred as F1) surrounded by the segment lines of great circle paths 11, 22, 21, 23, 12 and 13 in FIG. 3, the region (F2 which indicated by the black slanting lines in FIG. 4; hereinafter referred as F2) surrounding by the segment lines of great circle paths 13, 42, 41, 43, 11 and 12 in FIG. 3, the region(F3 which indicated by the black slanting lines in FIG. 4 hereinafter referred as F3) surrounded by the segment lines of great circle paths 12, 33, 31, 32, 13 and 11 in FIG. 3, the region(F4 which indicated by the black slanting lines in FIG. 4, this region is connected with the opposite half sphere which is not fully revealed in the drawing; hereinafter referred as F4) surrounded by the segment lines of great circle paths 33, 32, 21 and 23, and the region(F5 which indicated by the black slanting lines in FIG.

Figure 1:
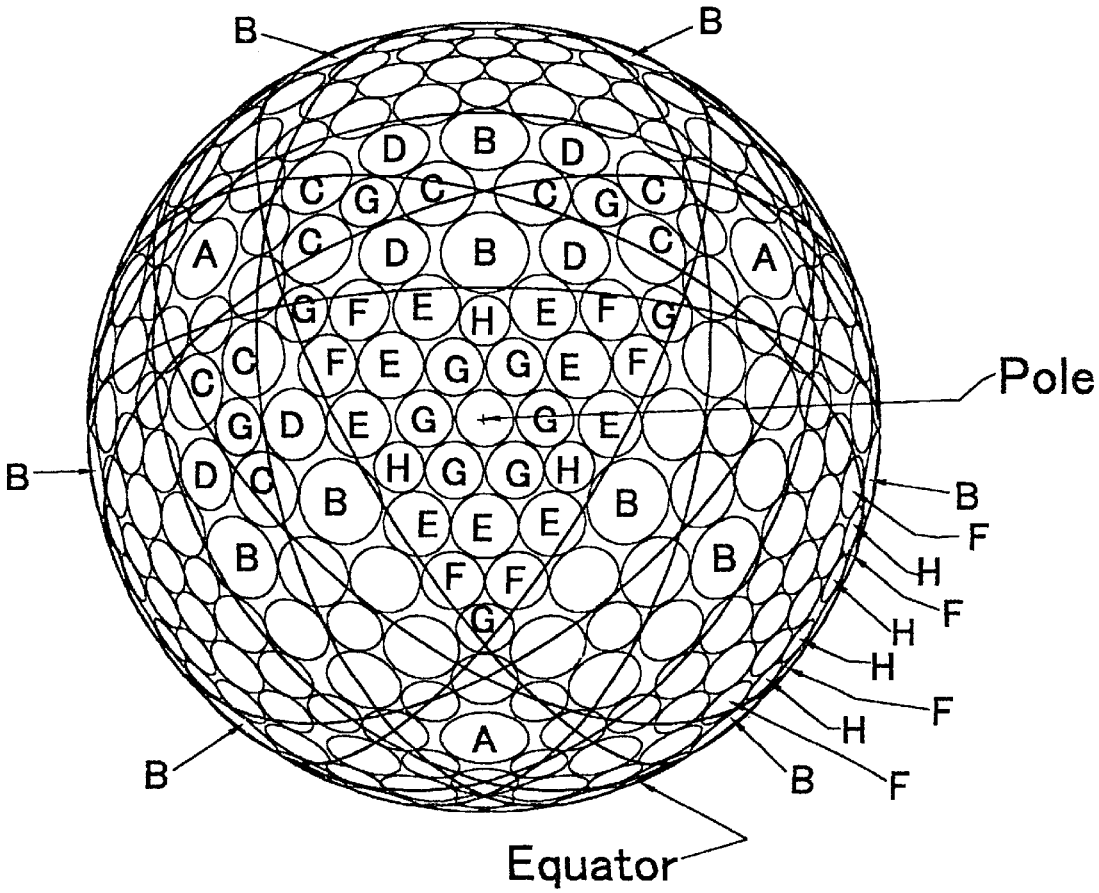
FIG. 1 is a polar view of the surface of golf ball according to the present invention, and shows the great circle paths which dividing the surface of sphere and the size of dimples in each position, the first large sized dimple being represented as A, in the order of the size B, C, D, E, F, G, and the smallest dimple being represented as H.

4, this region is connected with the opposite half sphere which is not fully revealed in the drawing; hereinafter referred as F5) surrounded by the segment lines of great circle paths 32, 33, 41 and 42, and the region(F6 which indicated by the black slanting lines in FIG. 4, this region is connected with the opposite half sphere which is not fully revealed in the drawing; hereinafter referred as F6) surrounded by the segment lines of great circle paths 43, 41, 23 and 22, and the region(F7 which indicated by the black slanting lines in FIG. 4, this region is connected with the opposite half sphere which is not fully revealed in the drawing; hereinafter referred as F7) surrounded by the segment lines of great circle paths 23, 22, 31 and 33, and the region(F8 which indicated by the black slanting lines in FIG. 4, this region is connected with the opposite half sphere which is not fully revealed in the drawing; hereinafter referred as F8) surrounded by the segment lines of great circle paths 32, 31, 43 and 42, and the region(F9 which indicated by the black slanting lines in FIG. 4, this region is connected with the opposite half sphere which is not fully revealed in the drawing; hereinafter referred as F9) surrounded by the segment lines of great circle paths 43, 42, 21 and 22. On the other hand, another regions(A which indicated in FIG. 1) which connect the sectionalized regions(F1, F2, F3, F4, F5, F6, F7, F8, F9) each other are set up, and the first large size dimples being arranged in this regions among the large dimples which minimize the air resistance in a low-speed area and easily transmit the air stream to the above mentioned F1~F9 regions. The region(S1 which indicated in FIG. 4; hereinafter referred as S1) surrounded by the segment lines of great circle paths 12, 23, 42, 13, 33, 41, 21 and 32 in FIG. 3, the region(S2 which indicated in FIG. 4; hereinafter referred as S2) surrounded by the segment lines of great circle paths 11, 22, 32, 13, 43, 31, 21 and 42, and the region(S3 which indicated in FIG. 4; hereinafter referred as S3) surrounded by the segment lines of great circle paths 12, 33, 43, 11, 23, 41, 31 and 22, six regions being formed in the spherical outer surface of golf ball, including three regions existed in the opposite half sphere which is not fully revealed in FIG. 4 of the drawings, and the first large size dimples being arranged in this regions.

Figure 4:
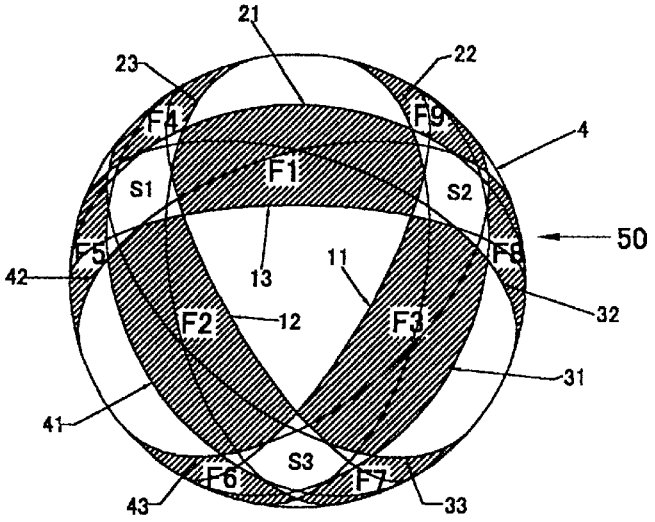
FIG. 4 shows the great circle paths of the divisional surface of the sphere and the regions which is formed by the segments of lines of each great circle for the dimple arrangement in accordance with the present invention, and shows the regions of S1, S2, S3(the first large sized dimples being positioned in those regions), and the regions of F1~F9 which are indicated by the black slanting lines in the drawing and arranged by the dimples relatively larger than those of the large spherical triangle surrounded by the lines of great circles 11, 12, 13 in the central region in the surface of the sphere by above 10% in size.
Figure 5:
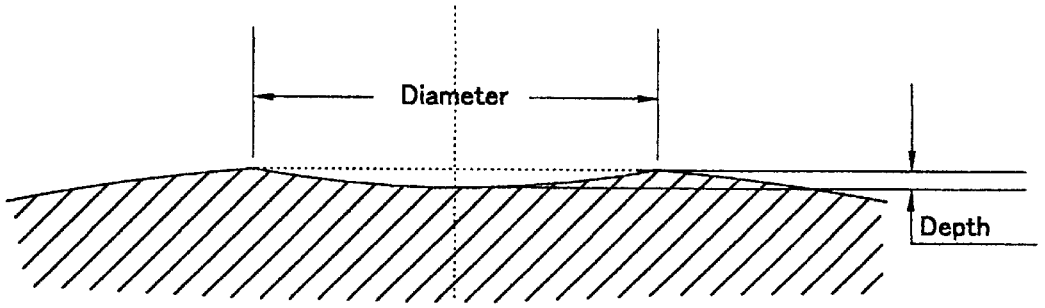
FIG. 5 shows the depth about the diameter of dimple.

On the other hand, the dimples in the regions(F1, F2, F3, F4, F5, F6, F7, F8, F9) are relatively larger than those of the large spherical triangle(which is surrounded by the segment lines of great circle paths 11, 12 and 13 in FIG. 4) in the central region in the surface of the sphere by above 10% in size, and connected to the first large size dimples which exist one by one in the regions of S1, S2, S3 (6 regions exist including three same regions in the opposite side of the sphere.) respectively in the surface of golf ball, in a form of band. The depth of the dimples may vary or be identical.

The air stream is so made as to restrict the generation of whirlpool in a low-speed area by the above mentioned dimple arrangement. In accordance with the dimple arrangement by the aforementioned dividing method, the golf ball has a spherical symmetry and the drag coefficient of the golf ball is reduced and the air resistance is minimized in a low-speed area during its flying, and therefore the carry distance is increased.

What is claimed is:

1. A golf ball having a spherical surface(50) with a plurality of dimples, the dimples being arranged in the spherical outer surface of sphere divided by a great circle path(13) which passing through the points P1(longitude 0 degree, latitude 0 degree), P2(longitude 30 degree, latitude 54.7356098 degree), P13(longitude 150 degree, latitude 54.7356098 degree) and P14(longitude 180 degree, latitude 0 degree), while an arbitrary point of the spherical outer surface acts as a pole, and further divided by a great circle path(11) which passing through the points P6(longitude 60 degree, latitude 0 degree), P2, P18(longitude 270 degree, latitude 54.7356098 degree) and P20(longitude 240 degree, latitude 0 degree), further divided by a great circle path(12) which passing through the points P10(longitude 120 degree, latitude 0 degree), P13, P18 and P23(longitude 300 degree, latitude 0 degree), further divided by a great circle path(21) which passing through the points P1, P5(longitude 60 degree, latitude 35.26438969 degree) and P14, further divided by a great circle path(22) which passing through the points P7(longitude 79.1066054 degree, latitude 0 degree), P25(longitude 330 degree, latitude 54.7356098 degree) and P21(longitude 259.1066054 degree, latitude 0 degree), further divided by a great circle path(23) which passing through the points P9(longitude 100.89339465 degree, latitude 0 degree), P17(longitude 210 degree, latitude 54.7356098 degree) and P22(longitude 280.89339465 degree, latitude 0 degree), further divided by a great circle path(41) which passing through the points P10, P15(longitude 180 degree, latitude 35.26438969 degree) and P23, further divided by a great circle path(42) which passing through the points P16(longitude 199.1066054 degree, latitude 0 degree), P8(longitude 90 degree, latitude 54.7356098 degree) and P3(longitude 19.1066054 degree, latitude 0 degree), further divided by a great circle path(43) which passing through the points P19 (longitude 220.89339465 degree, latitude 0 degree), P25 and P4(longitude 40.89339465 degree, latitude 0 degree), further divided by a great circle path(31) which passing through the points P20, P27(longitude 0 degree, latitude 35.26438969) and P6, further divided by a great circle path(33) which passing through the points P24 (longitude 319.1066054 degree, latitude 0 degree), P17 and P11(longitude 139.1066054 degree, latitude 0 degree), further divided by a great circle path(32) which passing through the points P26(longitude 340.89339465 degree, latitude 0 degree), P8 and P12(longitude 160.89339465 degree, latitude 0 degree), and the spherical outer surface being further divided by a great circle path(4) which acts as a equator, passing through the points P1, P7, P14, P16, and P24.

2. The golf ball of claim 1, wherein a region(F1) surrounded by the segment lines of great circle paths 11, 22, 21, 23, 12 and 13, a region (F2) surrounding by the segment lines of great circle paths 13, 42, 41, 43, 11 and 12, a region(F3) surrounded by the segment lines of great circle paths 12, 33, 31, 32, 13 and 11, a region(F4) surrounded by the segment lines of great circle paths 33, 32 , 21 and 23, a region(F5) surrounded by the segment lines of great circle paths 32, 33, 41 and 42, a region(F6) surrounded by the segment lines of great circle paths 43, 41, 23 and 22, a region(s) surrounded by the segment lines of great circle paths 23, 22, 31 and 33, an region(F8) surrounded by the segment lines of great circle paths 32, 31, 43 and 42, and a region(F9) surrounded by the segment lines of great circle paths 43, 42, 21 and 22 are regions which are able to induce the continuous regions of air stream, and a region(S1) surrounded by the segment lines of great circle paths 12, 23, 42, 13, 33, 41, 21 and 32, a region(S2) surrounded by the segment lines of great circle paths 11, 22, 32, 13, 43, 31, 21 and 42, and a region(S3) surrounded by the segment lines of great circle paths 12, .33, 43, 11, 23, 41, 31 and 22, and three same regions existed in the opposite half sphere are regions which connect the F1~F9 regions each other, and the first large size dimples are arranged in these regions among the large dimples which minimize the air resistance in a low-speed area and easily transmit the air stream to the F1~F9 regions, the dimples in the F1~F9 regions being relatively larger than those of the large spherical triangle surrounded by the segment lines of great circle paths 11, 12 and 13 in the central region in the surface of the sphere by above 10% in size, and connected to the first large size dimples which exist one by one in the regions of S1, S2, S3 (6 regions exist including three same regions in the opposite side of the sphere.) respectively in the surface of golf ball, in a form of band.

3. The golf ball of claim 1, wherein the dimples are arranged 4~8 kinds of diameter.

4. The golf ball of claim 2, wherein the dimples are arranged 4~8 kinds of diameter.

5. The golf ball of claim 1, wherein the dimples are arranged with various depths on the said sphere's surface.

6. The golf ball of claim 2, wherein the dimples are arranged with various depths on the said sphere's surface.

7. The golf ball of claim 1, wherein the dimples arranged on the said sphere's surface are identical in depth.

8. The golf ball of claim 2, wherein the dimples arranged on the said sphere's surface are identical in depth.

* * * * *